United States Patent [19]

Friedrich

[11] 4,080,232

[45] Mar. 21, 1978

[54] METHOD OF AND APPARATUS FOR MAKING TEXTILE SHEET STRUCTURES

[76] Inventor: Volker Friedrich, Sommeracherstr. 19, Volkach, Germany

[21] Appl. No.: 732,123

[22] Filed: Oct. 13, 1976

[30] Foreign Application Priority Data

Oct. 13, 1975 Germany ..... 2545782

[51] Int. Cl.[2] ..... D04H 3/05

[52] U.S. Cl. ..... 156/177; 28/101; 28/102; 156/178; 156/181; 156/440; 156/441

[58] Field of Search ..... 156/181, 176, 174, 177, 156/179, 440, 441, 439; 28/1 CL, 101, 102; 19/155; 66/84 A, 84 R

[56] References Cited

U.S. PATENT DOCUMENTS

| | | | |
|---|---|---|---|
| 2,548,467 | 4/1951 | Crise | 156/176 |
| 3,236,711 | 2/1966 | Adler | 156/174 |
| 3,595,722 | 7/1971 | Dawbarn | 156/177 |
| 3,607,565 | 9/1971 | Eaton | 156/181 |
| 3,720,570 | 3/1973 | Green et al. | 156/181 |
| 3,769,815 | 11/1973 | Ploch et al. | 66/85 A |
| 3,823,049 | 7/1974 | Vetrovec | 156/177 |
| 3,878,591 | 4/1975 | Jense | 28/1 CL |

*Primary Examiner*—William A. Powell
*Assistant Examiner*—Michael W. Ball
*Attorney, Agent, or Firm*—Owen, Wickersham & Erickson

[57] ABSTRACT

A method wherein a set of threads moved to and fro by means of a traversing device is laid down on the outer convex surface of a rotating cylindrical member, said to-and-fro motion of said set of threads being in the direction parallel to the axis of rotation of the cylindrical member, and wherein said threads are retained on the convex surface by retaining means and are removed from the cylindrical member.

11 Claims, 4 Drawing Figures

METHOD OF AND APPARATUS FOR MAKING TEXTILE SHEET STRUCTURES

The present invention relates to a method of making open-mesh (non-knitted and non-woven) net-like textile sheet structures of threads being laid on themselves in position to form the desired shape of mesh and being interconnected, and to an apparatus for carrying out said method.

There are already known a number of methods and apparatus for making such non-woven sheet structures (Gelege). In one of the known apparatus the transverse threads are laid upon a set of longitudinal threads by being passed from a disc supporting the supply bobbins and rotating over the longitudinal threads through thread guides to the edge of the set of longitudinal threads such that there they can be received each by a conveyor belt moving horizontally and provided with thread retaining pins. Said apparatus, however, has the disadvantage that there can be used only very few yarn bobbins and corresponding numbers of threads for the transverse threads, that the machine must be stopped each time a bobbin is exhausted or the thread is broken, or that unnecessary loss of yarn occurs along the thread pins (Offenlegungsschrift No. 1,635,677).

Another tubular net structure is obtained by a further known method wherein a plastic mass is extruded through nozzles to form threads, said nozzles being located on two rings rotating on the same shaft in opposite directions. Due to the fact that in the method just described there is no thread stretching and strengthening, which is necessary with synthetic fiber yarns, that thread structure possesses a very disadvantageous dilatability in conjunction with a low resistance to tearing (German Auslegeschrift No. 1,137,415).

Another known method is concerned with the laying of sets of threads or card webs on a horizontally moving conveyor belt by means of a traversing device moving to and fro transversely over the conveyor belt. This method, however, has the disadvantage that the threads are not fixed on the edge of the conveyor belt, and, as a result, the texture is irregular and the individual threads of the finished sheet structure do not have a uniform strain (German Offenlegungsschrift No. 1,926,951).

In a further known method, transverse threads are wound around a set of parallel longitudinal threads by a device rotating vertically to the direction of movement, lateral stiff metal strips preventing that the longitudinal threads are constricted to bundles. This method has the known disadvantages that only one or few supply bobbins can be used and, thus, a high production speed is not possible (German Auslegeschrift No. 1,087,559).

The above mentioned disadvantages of the methods hitherto known, which impaired the uniformity of the textile sheet structure, the strength thereof or the manufacturing speed, are overcome by the present invention. The object of the invention is to provide a method and an apparatus for carrying out same method wherein the production speed is increased, the transverse or diagonal threads are securely anchored on either edge of the laid material and the parallel configuration of said threads is safeguarded. Besides it is endeavoured by the invention to increase the stability of the fabric and to make possible that the process of a subsequent coating or lining of the fabric by means of foils is united with the laying of threads in one operation.

To achieve the above object, the invention suggests a method of the type mentioned in the beginning, wherein a set of threads moved to and fro by means of a traversing device is laid down on the outer convex surface of a rotating cylindrical member, said to-and-fro motion of said set of threads being in the direction parallel to the axis of rotation of the cylindrical member, and wherein said threads are retained on the convex surface by retaining means and are then interconnected to form said sheet structure and are removed from the cylindrical member. Owing to the reciprocating movement of said set of threads, which is brought about by means of the traversing device, and the simultaneous rotation of the cylindrical member, there is produced the open-mesh net-like sheet structure, i.e. Gelege (laid material). Owing to the use of the cylindrical member, the threads are subjected to arcuate tension and thus obtain a tension component which is directed to the center of the cylindrical member. Thereby the threads obtain a non-skid support and are automatically pressed on themselves. By optionally changing the frequency of the reciprocating motion of the traversing device and/or the speed of rotation of the cylindrical member and by selecting the number of threads of the set to be laid, it is possible to modify the relative angular position of the threads and, thus, the mesh pattern of the laid material to a large extent. In order to increase the stability of the sheet structure or laid material thus produced, in another embodiment of the invention a second set of threads may be laid on the cylindrical member in the direction of rotation of the same. In order to fix the threads of the laid material such that they are not displaceable relative to each other, the threads laid are interconnected at the points of intersection according to the invention. This can, for example, be done by glueing, welding or the like. To this purpose, an adhesive such as glue for example, may be applied to the threads, or there may be used threads that are provided with an adhesive coating from the very beginning. If the threads are to be welded together, the invention provides that the threads will be heated and pressed on themselves during the laying. Finally, the threads may also be embedded between two adhesive foils, one of the adhesive foils being applied to the surface of the cylindrical member before the set of threads is laid and the other adhesive foil being applied to to the surface of the cylindrical member after the set of threads has been laid, or an adhesive foil may be disposed between the two sets of threads.

For carrying out the above described method, the invention suggests an apparatus characterized by a cylindrical drum supported in a machine frame and rotatable by a drive means, and a traversing device comprising a guide rod holding the set of threads, said guide rod being adapted in its shape to conform with the convex peripheral surface of the drum and being spaced apart therefrom, and further comprising a crossrail extending parallel to the axis of rotation of the drum, said crossrail holding the guide rod and including a drive means for reciprocating the guide rod.

In a further embodiment of the apparatus the cylindrical drum includes barbs projecting from the convex peripheral surface to serve as retaining means for the threads laid, said barbs being arranged on either side of the peripheral surface and extending in a row along the circumference. For generating an additional pressing effect, there may be provided one or more press rollers in front of and/or behind the traversing device, seen in the direction of rotation of the drum, which press rollers abut to the peripheral surface and may be heated if necessary. If it is necessary to cool the threads, a cooling plate may, for example, be provided according to the invention in front of the traversing device seen in the direction of rotation, said cooling plate being adapted to the curvature of the drum and being arranged in the proximity thereof. For cutting off the threads as laid and interconnected from the cylindrical member, it is expedient to provide blades for severing the threads out of the hooks beside the rows of hooks in front of the traversing device, seen in the direction of rotation, and behind the cooling plate if the same is provided.

Embodiments of the invention will be hereinafter explained in detail with reference to the attached drawings, wherein FIG. 1 shows a segment of a winding of the sheet structure produced according to the method described in claim 1;

Figure 3:
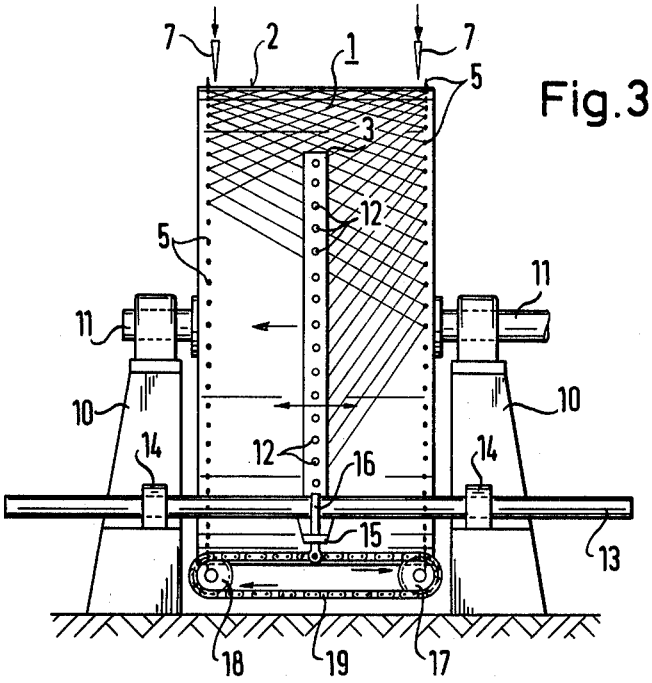
FIG. 3 shows a schematic view of an apparatus according to the invention, seen from the side of the transversing device towards the peripheral surface of the cylindrical member.
Figure 4:
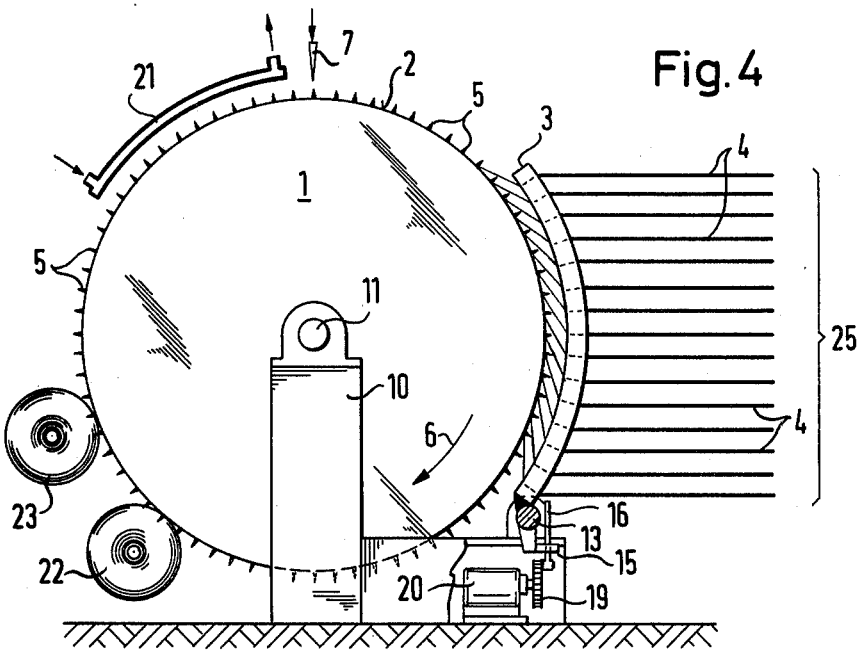
FIG. 4 shows a lateral view according to FIG. 3.

The apparatus for making open-mesh textile webs according to the invention, as is shown in FIGS. 3 and 4, comprises a cylindrical drum 1 rotatably mounted by means of a shaft 11 on a machine frame, said drum being drivable at a constant or selectable speed by a drive means not shown in the drawing, said drive means acting on the shaft 11. The drum 1 includes a peripheral surface 2, and the bent guide rod 3 of a traversing device for laying a set of yarn threads 4 on the peripheral surface 2 is adapted to the curvature of the same according to FIG. 4. The bent guide rod 3 is spaced apart from and extends parallel to the peripheral surface 2 (FIG. 4) and is reciprocated across the peripheral surface 2 in the direction of the axis of rotation of the drum 1 by means of a drive means which is described below in detail with an amplitude which approximately corresponds to the width of the drum 1, i.e. the peripheral surface 2. The guide rod 3 includes openings 12 or other suitable means for guiding one thread 4 of the set of threads each, said openings or means being arranged adjacent to each other in circumferential direction of the drum 1. The drum 1 includes retaining means for the threads 4 to be laid down by the guide rod 3, such as barbs 5, for example; said retaining means being disposed on both sides of the peripheral surface 2 along either edge at a spacing corresponding to the desired width of the textile web. The barbs 5 of each row are spaced apart from each other, the spacing corresponding to that between the openings 12 in the guide rod 3.

The guide rod 3 of the traversing means is mounted on a cross-bar 13 which is supported in bearing blocks 14 of the machine frame 10 such as not to rotate but to be displaceable parallel to the shaft 11 of the drum 1. A flange 15 is mounted on the cross-bar 13, said flange 15 having an opening with a follower pin 16 protruding therethrough, said follower pin being pivotally secured to a link of a chain 19 revolving over sprocket wheels 17, 18. The chain 19 can be put in motion by a motor 20 acting on one of the sprocket wheels 17 or 18, so that in each full revolution of the chain the guide rod 3 has been moved once to and fro. The follower pin 16 is of such a length that it still protrudes through the opening in the flange 15 even when the chain link that supports it is in its lower position. The drive means for the traversing device may also be designed in some other suitable way; there may, for example, be used a double acting hydraulic cylinder which puts the guide rod 3 in a controllable reciprocating motion across the width of the peripheral surface 2.

In front of the area covered by the guide rod 3, when seen in the direction of rotation of the drum 1, which is indicated by the arrow 6, there are provided blades, not shown in the drawing, for cutting off the laid material, said blades being arranged beside the rows of barbs 5. A cooling plate 21 with a cooling agent flowing therethrough may be provided in front of the blades 7 when seen in the direction of rotation of the drum 1. By way of example, reference numbers 22 and 23 designate two press rollers, which may be heated if necessary, and by means of which the threads 4 laid down on the peripheral surface 2 will be pressed thereagainst and, if the press rollers are heated, will be bonded to each other in the points of intersection under action of heat or will be coated with heat sealing foils. Means for feeding such foils onto the peripheral surface 2 in front of and/or behind the area of the guide rod 3 of the traversing device are not shown.

Figure 1:
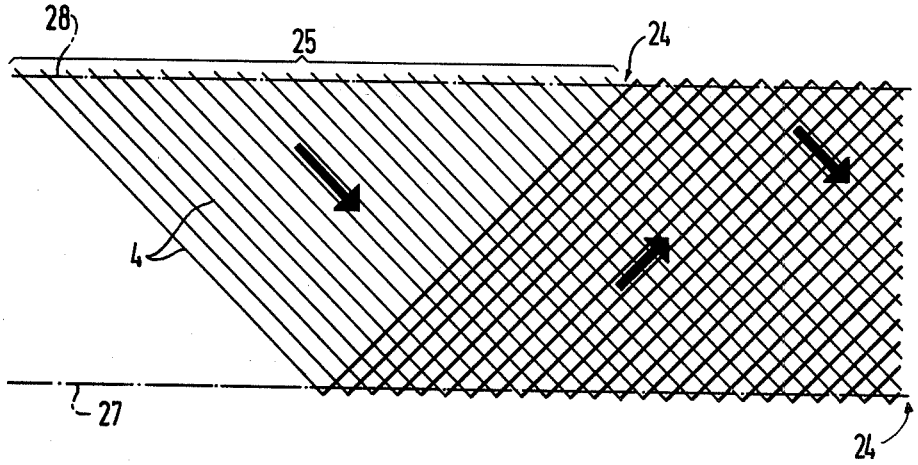
Figure 2:
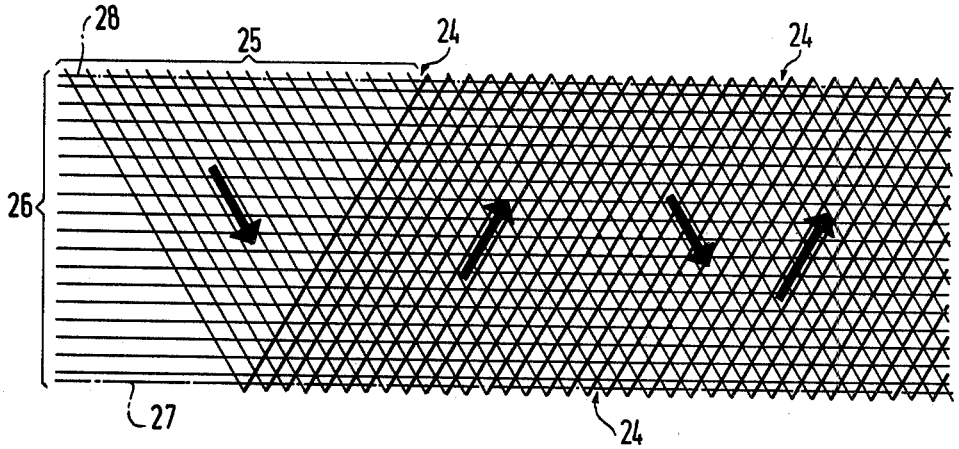
FIG. 2 shows a segment of a winding of the sheet structure made according to the method described in claim 2, i.e. including an additional set of longitudinal threads.

The apparatus functions as follows: The set of fed threads 4 is laid down on the peripheral surface 2 at an angle due to the fact that the guide rod 3 of the traversing device steadily reciprocates between the two rows of barbs 5 and the threads 4 of the set of threads are each retained by one barb 5 at each reversing point of the guide rod 3. The speed of the peripheral surface 2 and the reciprocating motion of the traversing device are adjusted relative to each other such that, for example, the path covered by the peripheral surface 2 in one full reciprocating motion of the guide rod 3 exactly corresponds to the width of the set of used threads 4 — or in other words: the number of barbs that have passed the guide rod 3. Thus it is safeguarded that at the end of each reciprocating motion (double stroke) the last thread of a retained set of threads lies on the rotating peripheral surface 2 exactly beside the first thread of a set of threads to be retained during the following double stroke, thus avoiding an overlapping of two parallel sets of threads or a gap therebetween (arrows 24 in FIGS. 1 and 2). Owing to the rotation of the drum 1, which also causes the threads 4 to be pulled from their bobbins, which are not shown in the drawing, the set of threads is laid diagonally to and fro across the curved peripheral surface 2, as is apparent from FIGS. 1 and 2. The respective directions in which the threads 4 of the set 25 are laid by the guide rod 3 upon the peripheral surface 2 are marked by bold arrows. In the embodiment according to FIG. 2, an additional set 26 of threads is laid in longitudinal direction (direction of rotation of the drum 1) via a rigid thread guiding-bar which is not shown in the drawing and extends vertically to the direction of the guide rod 3. Whereas the angle at which the threads 4 intersect in FIG. 1 is about 90°, the angle of intersection in the embodiment according to FIG. 2 is about 60°. This is achieved by using a lesser number of threads 4 in the set 25 and by adjusting the speed of rotation of the drum 1 and, thus, the speed of the peripheral surface 2 such that the same covers during one full reciprocating motion of the guide rod 3 a path that exactly corresponds to the lesser width of the used set of threads including less threads.

The mesh structure laid on the peripheral surface 2 in the abovedescribed or similar way is bonded at the points of intersection of the threads during one revolution of the drum in the manner known per se, by means of the heated rollers 22, 23 for example, thus being secured against displacement. Before the threads that have already been laid and connected, i.e. the finished textile sheet structure has reached again the area of the traversing device after a whole completed revolution of the drum 1, the blades 7 located at the edge of the drum will release the mesh structure from the lateral barbs 5 and clear the same for a renewed laying of threads. The cutting lines of the blades 7 are indicated in FIGS. 1 and 2 by the dash-dotted lines 27, 28.

The threads are fixed in position at the points of their intersection in the manner known per se by following possible steps, for example:

(1) Before the threads are laid on the peripheral surface 2, all of them pass through an impregnating tank or spray device filled with an adhesive liquid and are subsequently bonded together on the drum 1 by drying the adhesive liquid, or (2) there are used synthetic threads which are known as two-components yarns and include, for example, two polyamides melting at different temperatures (nylon 6 and nylon 6.6, for example), the lower of the two adhesion temperatures being used, or (3) a synthetic foil is laid between the sets of threads or on both sides of the sets of threads laid on the peripheral surface 2, which synthetic foil becomes adhesive at a specific temperature of the drum or peripheral surface and connects the sets of threads together. To this effect, the drum 1 or peripheral surface 2 may also be adapted for being heated.

The invention is not restricted to the above described apparatus. There are, of course, possible various modifications which lie within the scope of the inventive idea and are not described here in detail.

I claim:

1. A method for making an open-mesh, non-woven net-like continuous textile sheet structure of threads laid on themselves and interconnected, comprising:

feeding continuously a set of threads to a traversing device having means for dispensing the threads in aligned, generally equally spaced fashion;

laying down the threads from the traversing device continuously onto the outer convex surface of a rotating cylindrical drum, while moving the traversing member to and fro adjacent to the drum in a direction parallel to the axis of rotation of the drum, said threads being retained on the convex surface by radially extending barb retaining means engaging each thread at the ends of its to and fro motion;

connecting the threads together at their intersection points; and removing the resulting textile sheet structure from the drum at a point upstream from the traversing device.

2. The method of claim 1 wherein the advancing threads are moved to and fro by the traversing device at a frequency such that the drum surface travels a distance approximately equal to the arcuate distance between the first and last threads on the traversing device while the traversing device makes a full to and fro reciprocation.

3. The method of claim 1, further including the step of laying a second set of threads on the drum, said second set of threads being arranged parallel to one another and circumferential to the drum.

4. The method of claim 3 wherein the two sets of threads are connected together by interposing an adhesive foil between them as they are being laid on the drum.

5. The method of claim 1 wherein the threads are connected together by heating and pressing them together.

6. An apparatus for making an open-mesh, non-woven net-like continuous textile sheet structure of threads laid on themselves and interconnected, comprising:

a cylindrical drum rotatably mounted on a frame, with means for driving the drum;

an arcuately shaped traversing device conforming generally to the convex peripheral surface of the drum and spaced apart therefrom, said traversing device receiving a set of threads and having means for dispensing the threads in equally spaced relationship from the concave side of the device;

means mounting the traversing device on the frame for to and fro motion parallel to the axis of rotation of the drum, including a crossrail extending parallel to said axis, said crossrail holding the traversing device and including drive means for reciprocating the traversing device substantially through the width of the drum surface;

means radially extending barb for retaining threads of the convex peripheral surface of the drum;

whereby the threads may be laid over the moving convex drum surface while the traversing device reciprocates to and fro; and means for removing the textile sheet structure from the drum after the threads are connected together.

7. The apparatus of claim 6 wherein said barb retaining means comprises barbs projecting from the convex peripheral surface of the drum, extending in rows along the circumference of the surface near each edge, at a spacing corresponding to the spacing of the threads in the traversing device.

8. The apparatus of claim 7, further including blades positioned adjacent to the barbs, just inward therefrom, for severing the threads and releasing the resulting open-mesh textile sheet structure from the drum, on a continuous basis.

9. The apparatus of claim 6, further including at least one press roller having an axis parallel to the drum axis, engaging against the drum with the laid threads therebetween, for helping connect the threads together at intersecting points.

10. The apparatus of claim 9 wherein the threads are a synthetic material capable of being partially melted upon heating, wherein the press roller includes heating means, and wherein cooling means are provided along the path of the threads downstream of the press roller.

11. The apparatus of claim 6 wherein the speed of rotation of the drum and the frequency of reciprocation of the traversing device are such that the drum surface travels a distance approximately equal to the arcuate distance between the first and last threads on the traversing device while the traversing device makes a full to and fro reciprocation.

* * * * *